US009693918B1

(12) United States Patent
McCoy

(10) Patent No.: US 9,693,918 B1
(45) Date of Patent: Jul. 4, 2017

(54) LOWER LEG ELEVATION AND SUPPORT DEVICE

(71) Applicant: Donna McCoy, Hampton, VA (US)

(72) Inventor: Donna McCoy, Hampton, VA (US)

( * ) Notice: Subject to any disclaimer, the term of this patent is extended or adjusted under 35 U.S.C. 154(b) by 19 days.

(21) Appl. No.: 14/964,656

(22) Filed: Dec. 10, 2015

(51) Int. Cl.
*A47C 16/02* (2006.01)
*A61G 7/057* (2006.01)
*A61G 7/075* (2006.01)

(52) U.S. Cl.
CPC ..... *A61G 7/0755* (2013.01); *A47C 16/025* (2013.01)

(58) Field of Classification Search
CPC ..... A47C 16/02; A61G 7/0755
USPC ..... 5/640, 646–651
See application file for complete search history.

(56) References Cited

U.S. PATENT DOCUMENTS 3,644,949 A * 2/1972 Diamond ..... A47C 20/04 5/630
3,946,451 A * 3/1976 Spann ..... A61G 7/0755 5/650
4,071,031 A * 1/1978 Lowman ..... A61F 7/0085 128/DIG. 20
4,805,605 A 2/1989 Glassman
5,046,487 A 9/1991 Scott
5,716,334 A 2/1998 Wade
5,725,486 A 3/1998 Engelman
D619,404 S 7/2010 Castillo
8,322,343 B2 * 12/2012 Cardin ..... A61G 7/0755 128/845
2006/0089241 A1 4/2006 Klein et al.

FOREIGN PATENT DOCUMENTS

WO WO2013102246 7/2013

* cited by examiner

*Primary Examiner* — Fredrick Conley

(57) ABSTRACT

A lower leg elevation and support device for elevating and supporting a lower leg includes a lift and a plurality of wedges. The lift and each wedge having a thick end, a thin end, a bottom, a top, and a pair of opposing sides. The tops, the bottoms and the thick ends are substantially rectangular. The opposing sides are triangular, such that the lift and the wedges are cuneal. A slot extends from the thick end of the lift to proximate to the thin end of the lift, defining an upper section and a lower section of the lift. Each wedge is insertable into the slot, elevating the upper section of the lift relative to the lower section of the lift. A plurality of fasteners is configured to secure the lift to a leg of a user.

14 Claims, 4 Drawing Sheets

LOWER LEG ELEVATION AND SUPPORT DEVICE

BACKGROUND OF THE DISCLOSURE

Field of the Disclosure

The disclosure relates to support devices and more particularly pertains to a new support device for elevating and supporting a lower leg.

SUMMARY OF THE DISCLOSURE

An embodiment of the disclosure meets the needs presented above by generally comprising a lift and a plurality of wedges. The lift and each wedge having a thick end, a thin end, a bottom, a top, and a pair of opposing sides. The tops, the bottoms and the thick ends are substantially rectangular. The opposing sides are triangular, such that the lift and the wedges are cuneal. A slot extends from the thick end of the lift to proximate to the thin end of the lift, defining an upper section and a lower section of the lift. Each wedge is insertable into the slot, elevating the upper section of the lift relative to the lower section of the lift. A plurality of fasteners is configured to secure the lift to a leg of a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
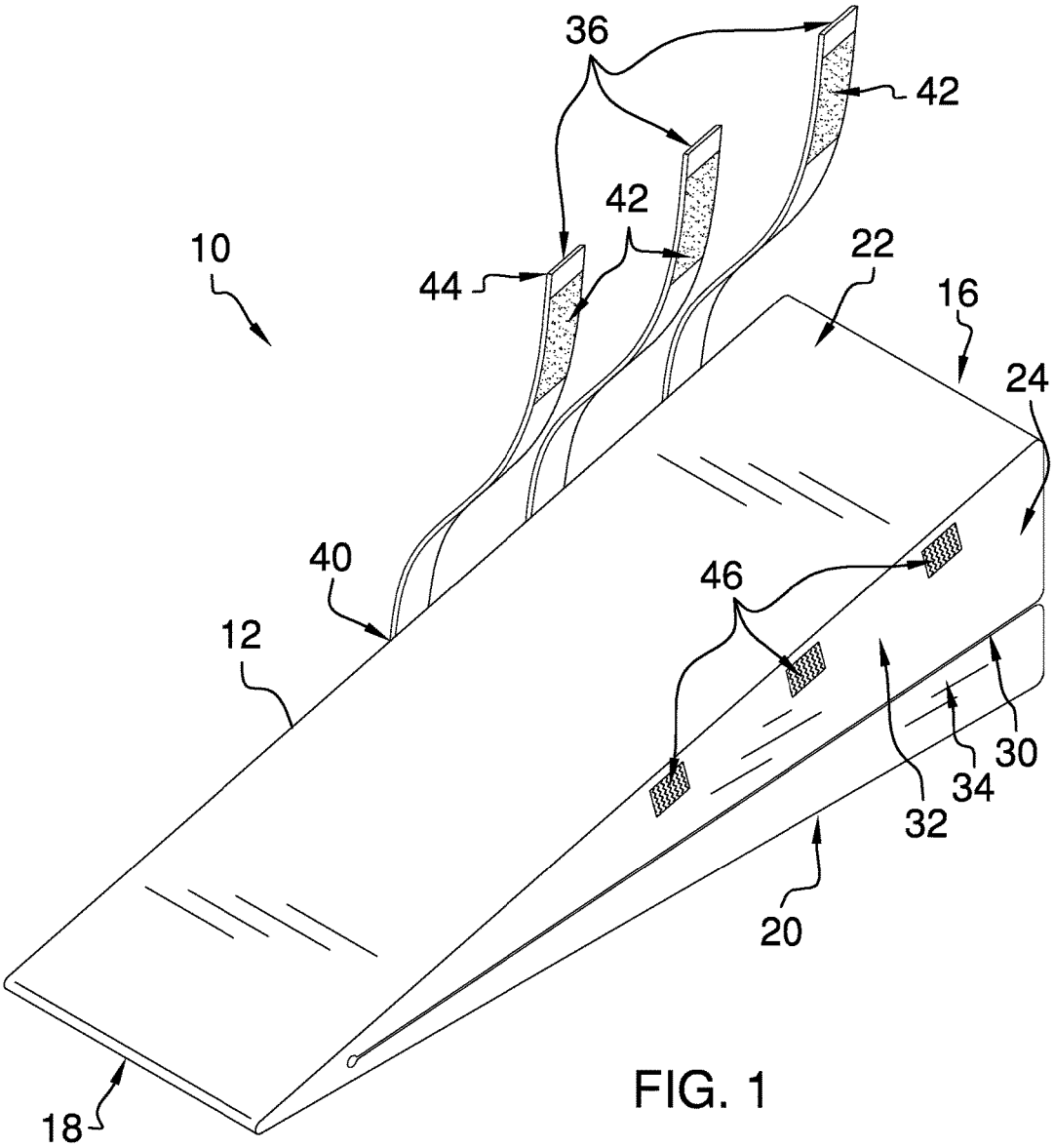
FIG. 1 is an isometric perspective view of a lower leg elevation and support device according to an embodiment of the disclosure.
Figure 2:
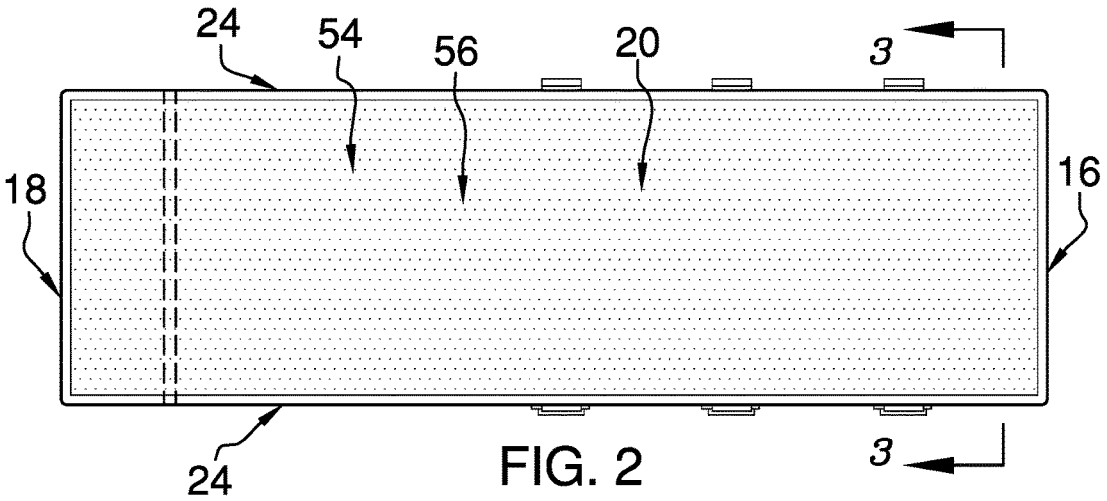
FIG. 2 is a bottom view of an embodiment of the disclosure.
Figure 3:
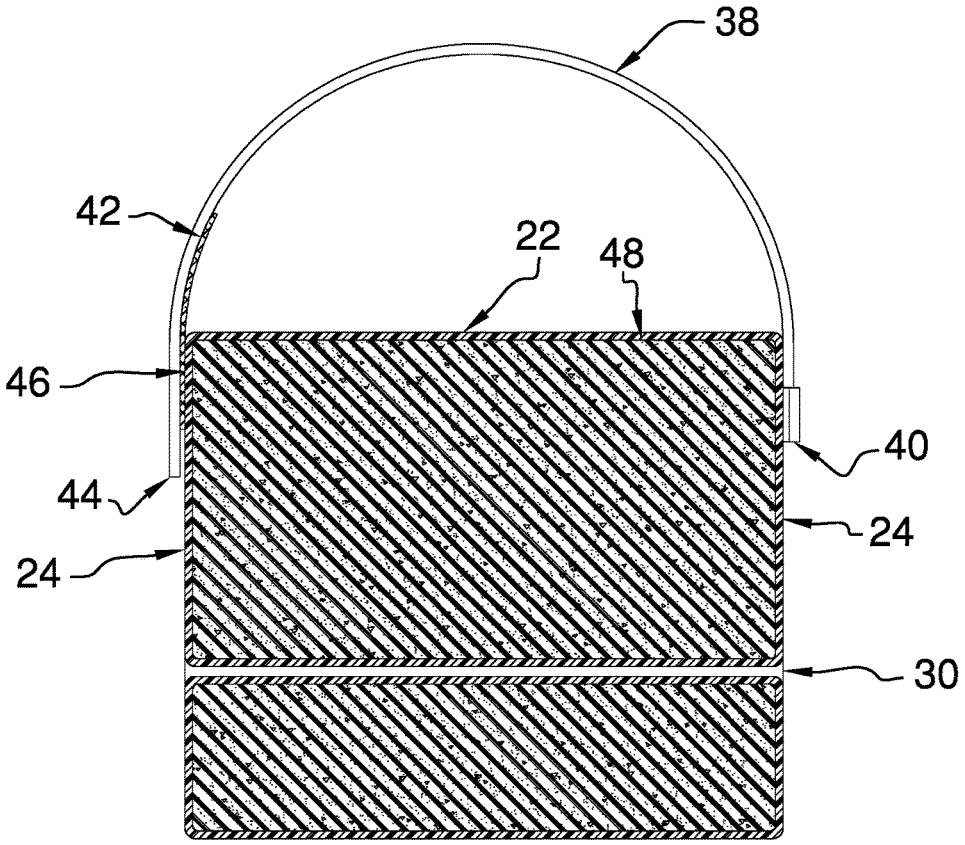
FIG. 3 is a cross-sectional view of an embodiment of the disclosure.
Figure 4:
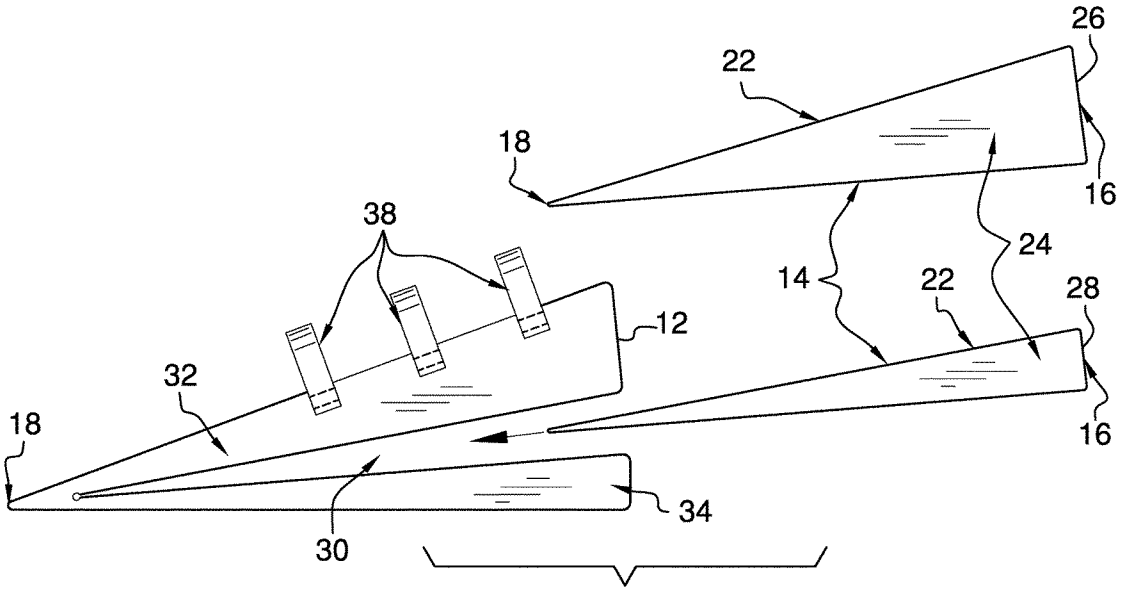
FIG. 4 is a side view of an embodiment of the disclosure.
Figure 5:
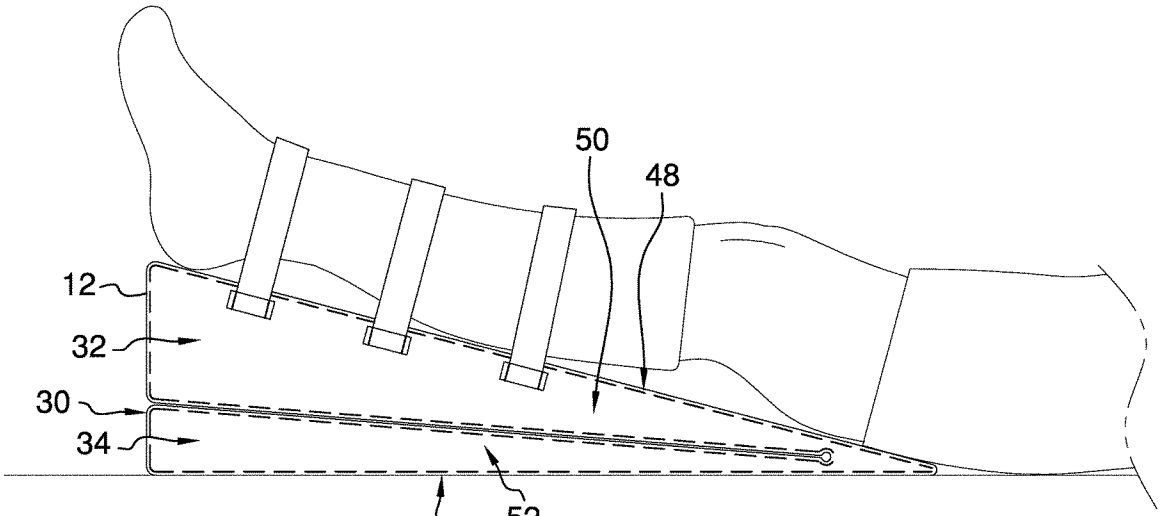
FIG. 5 is an in-use view of an embodiment of the disclosure.

With reference now to the drawings, and in particular to FIGS. 1 through 5 thereof, a new support device embodying the principles and concepts of an embodiment of the disclosure and generally designated by the reference numeral 10 will be described.

As best illustrated in FIGS. 1 through 5, the lower leg elevation and support device 10 generally comprises a lift 12 and a plurality of wedges 14. The lift 12 and each wedge 14 have a thick end 16, a thin end 18, a bottom 20, a top 22, and a pair of opposing sides 24. The tops 22, the bottoms 20 and the thick ends 16 are substantially rectangular. The opposing sides 24 are triangular, such that the lift 12 and the wedges 14 are cuneal. The lift 12 is pliable and comprises foam. Preferably, the lift 12 comprises stiffened foam.

The plurality of wedges 14 comprises a large wedge 26 and a small wedge 28. The thick end 16 of the large wedge 26 is dimensionally larger than the thick end 16 of the small wedge 28.

A slot 30 extends from the thick end 16 of the lift 12 to proximate to the thin end 18 of the lift 12, defining an upper section 32 and a lower section 34 of the lift 12. The slot 30 is complimentary to the wedges 14. Each wedge 14 is insertable into the slot 30 with the thin end 18 of the wedge 14 positioned proximate to the thin end 18 of the lift 12. Insertion of a wedge 14 elevates the upper section 32 of the lift 12 relative to the lower section 34 of the lift 12.

A plurality of fasteners 36 is configured to secure the lift 12 to a leg of a user. Preferably, the plurality of fasteners 36 comprises from two to five fasteners 36. More preferably, the plurality of fasteners 36 comprises three fasteners 36.

More specifically, the plurality of fasteners 36 comprises a plurality of straps 38. Each strap 38 has a first end 40 that is coupled to a respective opposing side 24 of the lift 12 proximate to the top 22 of the lift 12. Each of a plurality of first couplers 42 is coupled to a respective strap 38 proximate to a second end 44 of the respective strap 38. Each of a plurality of second couplers 46 is coupled to a respective opposing side 24 of the lift 12 proximate to the top 22 of the lift 12. Each second coupler 46 is aligned across the top 22 of the lift 12 to a respective first end 40 of a respective strap 38. The second couplers 46 are complimentary to the first couplers 42. Each second coupler 46 is positioned to reversibly couple with a respective first coupler 42 to secure a respective strap 38 around a leg positioned on the top 22 of the lift 12. Preferably, the first couplers 42 and the second couplers 46 are selected from the group of couplers consisting of hook-type and loop-type fasteners.

The device 10 includes a protector 48 that comprises an upper pocket 50 and a lower pocket 52. The upper pocket 50 is complimentary to the upper section 32 of the lift 12, and the lower pocket 52 is complimentary to the lower section 34 of the lift 12. The upper section 32 and the lower section 34 of the lift 12 are insertable into and removable from the protector 48, such that the protector 48 is removable from the lift 12.

A grip 54 is coupled to the bottom 20 of the lift 12. Preferably, the grip 54 comprises a non-slip material 56.

The lift 12 is dimensioned such that the thick end 16 of the lift 12 is positionable proximate to a heel of a user with the thin end 18 of the lift 12 positioned proximate to the hamstrings of the user.

In use, the lift 12 is positionable with the bottom 20 on a substantially horizontal surface. The lift 12 is configurable to attain a desired elevation of the leg of the user by optional insertion of a respective wedge 14 into the slot 30. The fasteners 36 are configured to secure the lift 12 to the leg of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lower leg elevation and support device comprising:

a lift and a plurality of wedges, said lift and each said wedge having a thick end, a thin end, a bottom, a top, and a pair of opposing sides;

said tops, said bottoms and said thick ends being substantially rectangular, said opposing sides being triangular, such that said lift and said wedges are cuneal;

a slot, said slot extending from said thick end of said lift to proximate to said thin end of said lift defining an upper section and a lower section of said lift, said slot being complimentary to said wedges;

each said wedge being insertable into said slot, such that said thin end of said wedge is positioned proximate to said thin end of said lift, such that said upper section of said lift is elevated relative to said lower section of said lift;

a plurality of fasteners, said fasteners being configured to secure said lift to a leg of a user; and wherein said lift is configurable to attain a desired elevation of the leg of the user by optional insertion of a respective said wedge into said slot, and wherein said fasteners are configured to secure said lift to the leg of the user.

2. The device of claim 1, further including said lift being pliable.

3. The device of claim 1, further including said lift comprising foam.

4. The device of claim 1, further including said lift comprising stiffened foam.

5. The device of claim 1, further including said plurality of wedges comprising a large wedge and a small wedge, such that said thick end of said large wedge is dimensionally larger than said thick end of said small wedge.

6. The device of claim 1, further including said plurality of fasteners comprising:

a plurality of straps, each said strap having a first end, said first ends being coupled to a respective said opposing side of said lift proximate to said top of said lift;

a plurality of first couplers, each said first coupler being coupled to a respective said strap proximate to a second end of said respective said strap;

a plurality of second couplers, each said second coupler being coupled to a respective said opposing side of said lift proximate to said top of said lift, such that each said second coupler is aligned across said top of said lift with a respective said first end of a respective said strap, said second couplers being complimentary to said first couplers; and wherein each said second coupler is positioned to reversibly couple with a respective said first coupler to secure a respective said strap around a leg positioned on said top of said lift.

7. The device of claim 6, further including said first couplers and said second couplers being selected from the group of couplers consisting of hook-type and loop-type fasteners.

8. The device of claim 1, further including said plurality of fasteners comprising from two to five fasteners.

9. The device of claim 8, further including said plurality of fasteners comprising three fasteners.

10. The device of claim 1, further including a protector, said protector comprising an upper pocket and a lower pocket, said upper pocket being complimentary to said upper section of said lift, said lower pocket being complimentary to said lower section of said lift, such that said upper section and said lower section of said lift are insertable into and removable from said protector, wherein said protector is removable from said lift.

11. The device of claim 1, further including a grip, said grip being coupled to said bottom of said lift.

12. The device of claim 11, further including said grip comprising a non-slip material.

13. The device of claim 1, further including said lift being dimensioned such that said thick end of said lift is positionable proximate to a heel of the user with said thin end of said lift positioned proximate to the hamstrings of the user.

14. A lower leg elevation and support device comprising:

a lift and a plurality of wedges, said lift and each said wedge having a thick end, a thin end, a bottom, a top, and a pair of opposing sides;

said tops, said bottoms and said thick ends being substantially rectangular;

said opposing sides being triangular, such that said lift and said wedges are cuneal;

said lift being pliable, said lift comprising foam, said lift comprising stiffened foam;

said plurality of wedges comprising a large wedge and a small wedge, such that said thick end of said large wedge is dimensionally larger than said thick end of said small wedge;

a slot, said slot extending from said thick end of said lift to proximate to said thin end of said lift defining an upper section and a lower section of said lift, said slot being complimentary to said wedges;

each said wedge being insertable into said slot, such that said thin end of said wedge is positioned proximate to said thin end of said lift, such that said upper section of said lift is elevated relative to said lower section of said lift;

a plurality of fasteners, said fasteners being configured to secure said lift to a leg of a user, said plurality of fasteners comprising from two to five fasteners, said plurality of fasteners comprising three fasteners, said plurality of fasteners comprising:

a plurality of straps, each said strap having a first end, said first ends being coupled to a respective said opposing side of said lift proximate to said top of said lift, a plurality of first couplers, each said first coupler being coupled to a respective said strap proximate to a second end of said respective said strap, a plurality of second couplers, each said second coupler being coupled to a respective said opposing side of said lift proximate to said top of said lift, such that each said second coupler is aligned across said top of said lift with a respective said first end of a respective said strap, said second couplers being complimentary to said first couplers, and wherein each said second coupler is positioned to reversibly couple with a respective said first coupler to secure a respective said strap around a leg positioned on said top of said lift;

said first couplers and said second couplers being selected from the group of couplers consisting of hook-type and loop-type fasteners;

a protector, said protector comprising an upper pocket and a lower pocket, said upper pocket being complimentary to said upper section of said lift, said lower pocket being complimentary to said lower section of said lift, such that said upper section and said lower section of said lift are insertable into and removable from said protector, wherein said protector is removable from said lift;

a grip, said grip being coupled to said bottom of said lift, said grip comprising a non-slip material;

said lift being dimensioned such that said thick end of said lift is positionable proximate to a heel of a user with said thin end of said lift positioned proximate to the hamstrings of the user; and wherein said lift is positionable with said bottom on a substantially horizontal surface, wherein said lift is configurable to attain a desired elevation of the leg of the user by optional insertion of a respective said wedge into said slot, and wherein said fasteners are configured to secure said lift to the leg of the user.

* * * * *